US010448766B2

(12) United States Patent
Bass et al.

(10) Patent No.: US 10,448,766 B2
(45) Date of Patent: Oct. 22, 2019

(54) TABLECLOTH

(71) Applicants: Priscilla Bass, Savannah, GA (US); Bruce D. Bass, Savannah, GA (US)

(72) Inventors: Priscilla Bass, Savannah, GA (US); Bruce D. Bass, Savannah, GA (US)

( * ) Notice: Subject to any disclaimer, the term of this patent is extended or adjusted under 35 U.S.C. 154(b) by 0 days.

(21) Appl. No.: 15/964,318

(22) Filed: Apr. 27, 2018

(65) Prior Publication Data

US 2018/0310739 A1 Nov. 1, 2018

Related U.S. Application Data

(60) Provisional application No. 62/490,821, filed on Apr. 27, 2017.

(51) Int. Cl.
*A47G 11/00* (2006.01)

(52) U.S. Cl.
CPC ..... *A47G 11/004* (2013.01)

(58) Field of Classification Search
CPC ..... A47G 11/004
USPC ..... 108/90
See application file for complete search history.

(56) References Cited

U.S. PATENT DOCUMENTS 2,491,894 A 12/1949 Henry
2,728,165 A * 12/1955 Runyon ..... A47G 11/003 108/90
3,368,601 A * 2/1968 Gantert-Merz ..... A47G 11/006 108/31
3,960,193 A * 6/1976 Davis ..... A47G 11/003 108/90
5,908,681 A * 6/1999 Foster ..... A47G 11/004 108/90
6,044,774 A * 4/2000 Gelbart ..... A47B 95/043 108/90
6,381,812 B1 5/2002 Crider et al.
6,591,764 B1 * 7/2003 Dean ..... A63F 1/06 108/27
8,807,503 B2 8/2014 Zavala
2006/0046021 A1 * 3/2006 Morris ..... A47B 95/043 428/99
2006/0174410 A1 * 8/2006 Mastandrea, Jr. ... A01K 1/0353 5/482
2006/0231196 A1 * 10/2006 Zorzi ..... A47G 9/0284 156/247
2007/0051285 A1 * 3/2007 French ..... A47G 11/004 108/90
2009/0038516 A1 * 2/2009 Gerow ..... A47G 11/003 108/50.11
2009/0241308 A1 * 10/2009 Kovacs ..... A47G 11/004 27/1
2010/0017960 A1 * 1/2010 Blaauboer ..... A47G 9/062 5/417

(Continued)

*Primary Examiner* — Hanh V Tran
(74) *Attorney, Agent, or Firm* — Global Intellectual Property Agency, LLC; Daniel Boudwin

(57) ABSTRACT

A tablecloth. The tablecloth includes a flexible base having a perimeter edge, wherein the perimeter edge includes a securement member therein for removably securing the base to a table surface, such that a lower surface of the base rests flush against the table surface. The base further includes a plurality of inserts embedded within the base at intervals, wherein the inserts conform to an edge of the table to further secure and align the base with the table surface.

8 Claims, 3 Drawing Sheets

(56) References Cited

U.S. PATENT DOCUMENTS

| | | | | |
|---|---|---|---|---|
| 2010/0132595 | A1* | 6/2010 | Gledhill | A47G 11/003 108/90 |
| 2011/0100269 | A1* | 5/2011 | Hull | A47G 11/004 108/90 |
| 2013/0190157 | A1* | 7/2013 | Gogiberidze | A47C 31/10 493/394 |
| 2013/0305496 | A1* | 11/2013 | Zavala, Jr. | A47G 29/08 24/303 |
| 2014/0299608 | A1* | 10/2014 | Melo | A47D 1/008 220/574.1 |
| 2015/0223597 | A1* | 8/2015 | Albanese | A47B 1/00 108/90 |
| 2017/0347817 | A1* | 12/2017 | Dessaint Kimura | A47G 11/004 |

* cited by examiner

TABLECLOTH

CROSS REFERENCE TO RELATED APPLICATIONS

This application claims the benefit of U.S. Provisional Application No. 62/490,821 filed on Apr. 27, 2017. The above identified patent application is herein incorporated by reference in its entirety to provide continuity of disclosure.

BACKGROUND OF THE INVENTION

The present invention relates to a tablecloth. Specifically, the present invention relates to tablecloth having a securing member about a perimeter edge thereof, such that the table cloth can removably secure to a table to prevent the tablecloth being removed therefrom during inclement weather and the like.

Many people enjoy entertaining outside, which often involves the use of tablecloths to protect an outdoor table, such as a picnic table, from spills and other messes. However, these tablecloths are prone to blowing away in windy conditions, leaving a table unprotected. Additionally, food and drinks that were resting on the tablecloth can be overturned as the tablecloth blows away. Typically, people attempt to weigh down tablecloths using rocks, tape, clamps, and the like, however these solutions can be time consuming, inconvenient, and unsanitary. Furthermore, these weighted objects are prone to being removed by guests unaware of their purpose. Therefore, a tablecloth that can be easily secured to a table to prevent inclement weather from removing the tablecloth therefrom is desired.

In light of the devices disclosed in the known art it is submitted that the present invention substantially diverges in design elements from the known art and consequently it is clear that there is a need in the art for an improvement to existing tablecloths. In this regard, the instant invention substantially fulfills these needs.

SUMMARY OF THE INVENTION

In view of the foregoing disadvantages inherent in the known types of tablecloths now present in the prior art, the present invention provides a tablecloth wherein the same can be utilized for providing convenience for the user when using a tablecloth during periods of high wind or other inclement weather conditions.

The present system comprises a flexible base having a perimeter edge, wherein a lower surface of the base is configured to rest flush against an upper surface of a table. The perimeter edge further comprises a securing member therein, wherein the securing member is configured to removably secure the base about an edge of the table. The base further comprises a plurality of inserts embedded therein at intervals, wherein the plurality of inserts are dimensioned to conform to the edge of the table. In some embodiments, the plurality of inserts comprise L-shaped members configured to conform to a corner of the table. In other embodiments, the plurality of inserts comprise an arcuate shape configured to conform to the edge of the table. In another embodiment, the plurality of inserts are disposed equiangularly about the base. In yet another embodiment, the securing member comprises an elastic material, wherein the elastic is configured to removably secure the base to the table. In some embodiments, the securing member comprises a drawstring having a cord lock thereon, wherein the cord lock is configured to secure the perimeter edge about the table. In another embodiment, the base further comprises reinforced sections disposed about the plurality of inserts, the reinforced sections configured to prevent tearing of the base. In other embodiments, the base further comprises a plurality of pockets thereon, wherein each of the plurality of pockets are configured to receive one of the plurality of inserts therein. In yet another embodiment, the base comprises a waterproof material.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
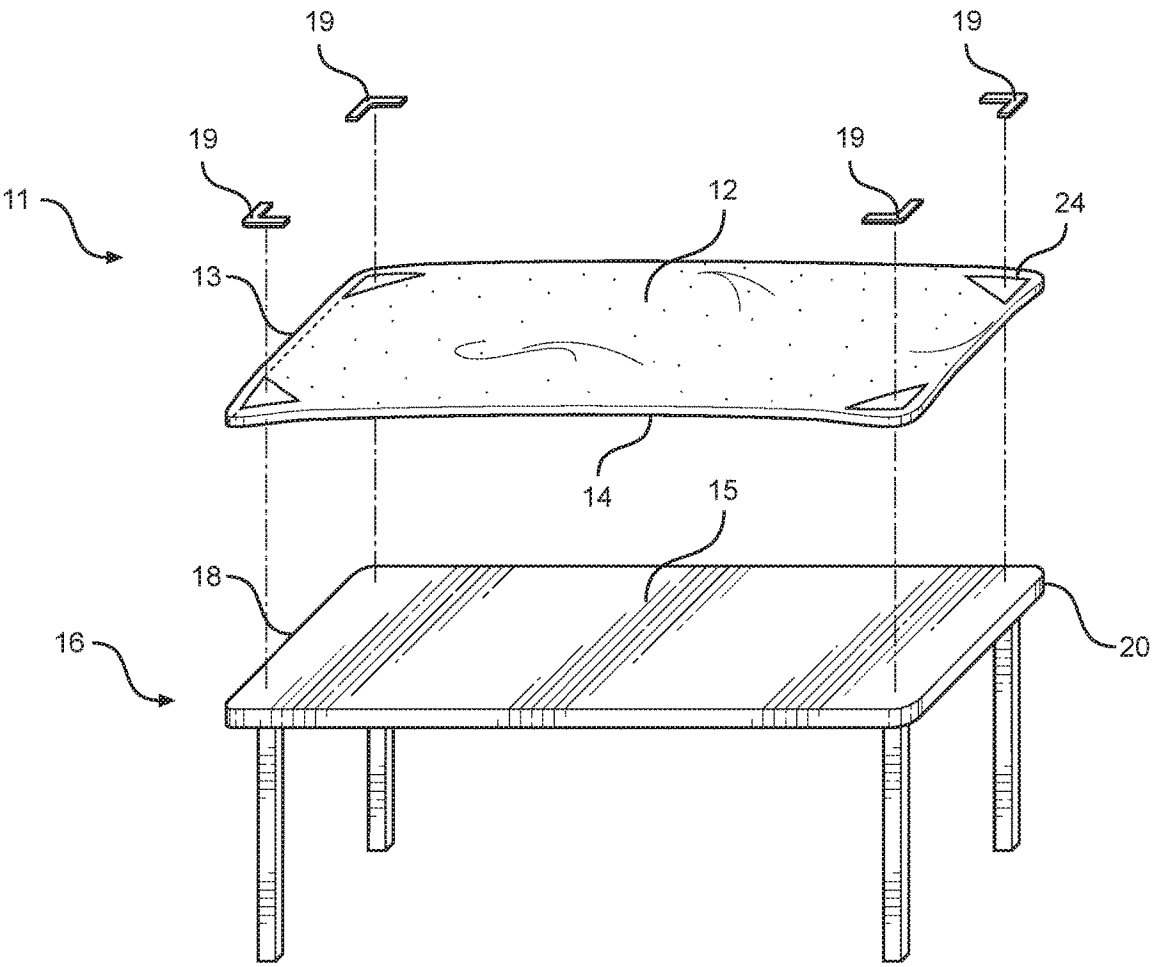
FIG. 1 shows an exploded view of an embodiment of the tablecloth and a table.

Reference is made herein to the attached drawings. Like reference numerals are used throughout the drawings to depict like or similar elements of the tablecloth. The figures are intended for representative purposes only and should not be considered to be limiting in any respect.

Referring now to FIG. 1, there is shown an exploded view of an embodiment of the tablecloth and a table. The tablecloth 11 comprises a flexible base 12, wherein the base 12 further comprises a perimeter edge 13. The base 12 is dimensioned to fit a table 16, such that the perimeter edge 13 extends about an edge 18 of the table 16. In the illustrated embodiment, the base 12 comprises a rectangular form factor, however alternate cross-sections are contemplated, including square, circular, hexagonal, and the like. A lower surface 14 of the base 12 is configured to rest flush against an upper surface 15 of the table 16. In this way, the base 12 is configured to rest flat such that any objects placed upon the table 16 are maintained in a stable position. When secured to the table 16, the perimeter edge 13 extends and drapes over the edge 18 to rest along a lower surface of the table 16, wherein the lower surface of the table 16 is opposite the upper surface 15. The perimeter edge 13 cinches about the table 16, such that the diameter of the perimeter edge 13 is less than a diameter of the table 16 when in the cinched position, thereby securing the base 12 to the table 16. In some embodiments, the perimeter edge 13 cinches via elastic properties, while in other embodiments, the perimeter edge 13 cinches via a drawstring mechanism. The base 12 can comprise a variety of flexible materials, however in some embodiments, the base 12 comprises a waterproof material, such that any spills that occur do not seep through the base 12 and damage the table 16.

The tablecloth 11 further comprises a plurality of inserts 19, wherein the plurality of inserts 19 are configured to conform to the edge 18 of the table 16. In this way, the plurality of inserts 19 serve to align the base 12 with the table 16, while also preventing the base 12 from sliding along the upper surface 15 due to external forces. The plurality of inserts 19 anchor the base 12 to the table 16. In the illustrated embodiment, the plurality of inserts 19 comprise an L-shape configured to conform to a corner 20 of the table 16, such that the plurality of inserts 19 can secure the base 12 in place on a table 16 having a rectangular or square table 16. However, in alternate embodiments, the plurality of inserts 19 comprise arcuate members such that the inserts 19 can conform to a circular table 16, or inserts 19 comprising varying angles, such that the inserts 19 can conform to varying degrees of polygonal table 16 shapes. In another embodiment, the plurality of inserts 19 further comprise an upper portion perpendicularly affixed to a lower portion, such that the upper portion is configured to rest flush against the upper surface 15 of the table 16 and the lower portion is configured to rest flush against an outer surface of the edge 18. In this way, the inserts 19 can further secure the base 12 in a desired position, while ensuring that the plurality of inserts 19 remain in place along the edge 18. In some embodiments, the plurality of inserts 19 are embedded within the base 12, such that the plurality of inserts 19 are permanently affixed between an outer layer of the base 12 and an inner layer of the base 12 via stitching or other such fastening methods.

In the illustrated embodiment, the base 12 further comprises a plurality of pockets 24 thereon, wherein the plurality of pockets 24 are configured to removably secure the plurality of inserts 19 therein. In this way, the plurality of inserts 19 are removably securable to base 12, such that a user can interchangeably use a variety of differently shaped inserts 19. Furthermore, the ability to remove the plurality of inserts 19 from the base 12 allows a user to easily wash the tablecloth 11 within a washing machine or the like. In these embodiments, the plurality of pockets 24 can further include a fastener configured to secure each pocket 24 in a closed position, such that the plurality of inserts 19 remain therein. In some embodiments, the base 12 further comprises reinforced sections having several additional layers of base 12 material stitched therearound, such that the base 12 has increased durability about the plurality of inserts 19, such that sharp corners 20 or edges 18 of the table 16 do not tear the base 12. In this way, the base 12 is durable enough to be reused several times, thereby minimizing user expenditure on replacement tablecloths 11.

Figure 2A:
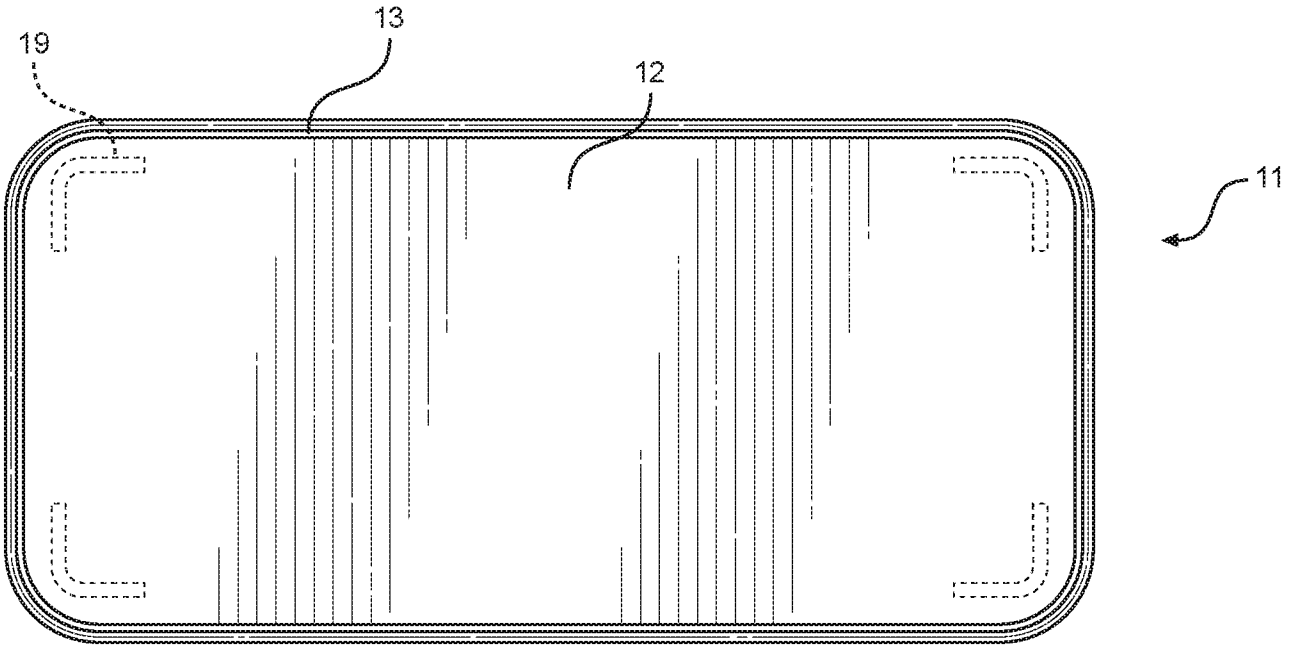
FIG. 2A shows an underside view of an embodiment of the tablecloth.
Figure 2B:
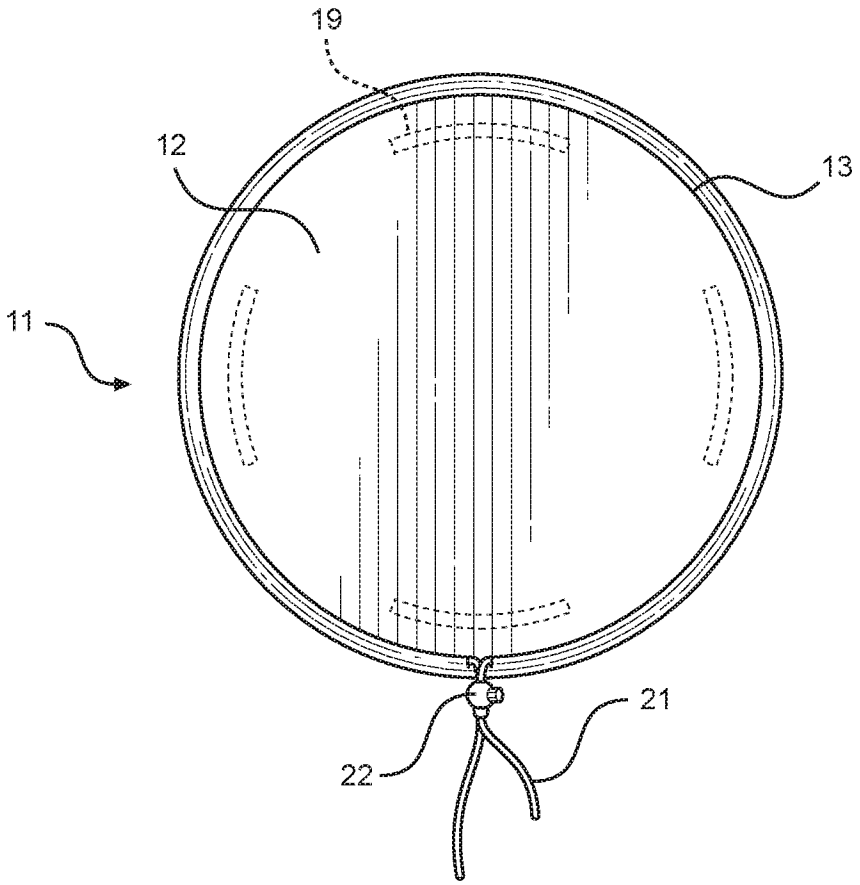
FIG. 2B shows an underside view of an alternate embodiment of the tablecloth.

Referring now to FIGS. 2A and 2B, there are shown underside views of various embodiments of the tablecloth. In the illustrated embodiment of 2A, the base 12 comprises a rectangular shape having a plurality of inserts 19 embedded therein, wherein the plurality of inserts 19 comprise L-shaped members configured to engage the edge of the table. In the illustrated embodiment of 2B, the base 12 comprises a circular shape dimensioned to fit a circular table, wherein the plurality of inserts 19 embedded therein comprise arcuate members configured to engage the edge of the table. In some embodiments, the plurality of inserts 19 are further disposed equiangularly about the base 12, such that the tablecloth 11 is secured thereto, such that rotation of the tablecloth 11 is minimized when the tablecloth is secured to the table.

In the illustrated embodiment, the base 12 further comprises a securing member disposed within the perimeter edge 13, wherein the securing member is configured to removably secure the base 12 to the table. In the illustrated embodiment of FIG. 2A, the securing member comprises an elastic material, wherein the elastic material is configured to constrict to a diameter less than that of the table, such that the base 12 is secured to table when the base 12 is positioned on the table such that the perimeter edge 13 is positioned below the edge of the table. In the illustrated embodiment of FIG. 2B, the securing member comprises a drawstring 21, wherein the drawstring 21 further comprises a cord lock 22 thereon. The drawstring 21 is disposed within the perimeter edge 13 such that opposing ends of the drawstring 21 extend therethrough. The cord lock 22 comprises a spring biased clamp, wherein the opposing ends of the drawstring 21 are configured to be secured together by the cord lock 22. The perimeter edge 13 can be tightened via the drawstring 21 by actuating the spring biased clamp of the cord lock 22 to slide the cord lock 22 along the drawstring 21. In this way, the perimeter edge 13 can be constricted such that the base 12 is removably secured to the table.

In one exemplary use, the user places the base 12 on the upper surface of the table, such that the perimeter edge 13 extends over the edge of the table. The perimeter edge 13 can then be constricted via the securing member about the edge of the table, such that the base 12 is removably secured thereto. In some embodiments, the elastic is stretched to a larger diameter than the table, such that when the perimeter edge 13 has extended past the edge of the table, the elastic is then released to constrict about the table, thereby securing the base 12 to the table. In an embodiment featuring a drawstring 21, the user can tighten the drawstring 21 by actuating and sliding the cord lock 22 therealong. The base 12 can then be positioned and adjusted such that the lower surface of the base 12 rests flush with the upper surface of the table and the plurality of inserts 19 engage an edge of the table. In some embodiments, the plurality of inserts 19 can be removably secured within the plurality of pockets within the base 12. In this way, the user can easily remove the plurality of inserts 19 when the base 12 is removed from the table, such that the base 12 can be washed or otherwise cleaned without causing unnecessary damage to the base 12.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tablecloth, comprising:

a flexible base having a perimeter edge;

wherein a lower surface of the base is configured to rest flush against an upper surface of a table;

wherein the perimeter edge further comprises a securing member therein, wherein the securing member is configured to removably secure the base about an edge of the table;

wherein the base further comprises a plurality of inserts embedded therein at intervals, the plurality of inserts dimensioned to conform to the edge of the table;

wherein the plurality of inserts comprise an arcuate shape configured to conform to the edge of the table and are disposed equiangularly about the base.

2. The tablecloth of claim 1, wherein the plurality of inserts comprise L-shaped member configured to conform to a corner of the table.

3. The tablecloth of claim 1, wherein the securing member comprises an elastic material, wherein the elastic material is configured to removably secure the base to the table.

4. The tablecloth of claim 1, wherein the securing member comprises a drawstring having a cord lock thereon, wherein the cord lock is configured to secure the perimeter edge about the table.

5. The tablecloth of claim 1, wherein the base further comprises reinforced sections disposed about the plurality of inserts, the reinforced sections configured to prevent tearing of the base.

6. The tablecloth of claim 1, wherein the base further comprises a plurality of pockets thereon, each of the plurality of pockets configured to receive one of the plurality of inserts therein.

7. The tablecloth of claim 1, wherein the base comprises waterproof material.

8. A tablecloth, comprising:

a flexible base having a perimeter edge;

wherein a lower surface of the base is configured to rest flush against an upper surface of a table;

wherein the perimeter edge further comprises a securing member therein, wherein the securing member is configured to removably secure the base about an edge of the table;

wherein the base further comprises a plurality of inserts embedded therein at intervals;

wherein the plurality of inserts are dimensioned to conform to the edge of the table;

wherein the base further comprises a plurality of pockets thereon, wherein each of the plurality of pockets is configured to receive one of the plurality of inserts therein.

* * * * *